United States Patent [19]

Nakako et al.

[11] 4,144,033

[45] Mar. 13, 1979

[54] PROCESS FOR MANUFACTURING METALLURGICAL CABONACEOUS MATERIALS FROM COALS

[75] Inventors: Yukio Nakako; Shizuo Yokota, both of Nishinomiya, Japan

[73] Assignee: Kobe Steel, Ltd., Kobe, Japan

[21] Appl. No.: 835,412

[22] Filed: Sep. 20, 1977

[30] Foreign Application Priority Data

Sep. 20, 1976 [JP] Japan ..... 51-112676
Sep. 20, 1976 [JP] Japan ..... 51-112677

[51] Int. Cl.[2] ..... C10L 9/00; C10B 57/12; C10G 1/06

[52] U.S. Cl. ..... 44/1 F; 201/38; 208/9

[58] Field of Search ..... 44/1 B, 1 F; 208/8, 208/9; 201/38

[56] References Cited

U.S. PATENT DOCUMENTS 3,808,119 4/1974 Bull et al. ..... 208/8
3,926,775 12/1976 Schroeder ..... 208/8 X

FOREIGN PATENT DOCUMENTS 469048 7/1937 United Kingdom ..... 44/1 B

*Primary Examiner*—Carl Dees
*Attorney, Agent, or Firm*—Oblon, Fisher, Spivak, McClelland & Maier

[57] ABSTRACT

A process for manufacturing metallurgical carbonaceous materials from coals, particularly coals of a low rank of coalification, in which coal fines and a hydrocarbon base solvent having a boiling point of 150° to 500° C. are mixed together into a slurry form, then the slurry is subjected to a first heat treatment wherein the slurry is treated in the presence of a mixture gas including carbon monoxide and steam under a pressure of 50 to 300 atms. and temperature of 300° to 600° C., and then the reaction product thus derived is subjected to a second heat treatment wherein the reaction product is treated in the presence of a hydrogen gas at a low partial pressure, at a pressure 10 mmHg to 250 atms, and temperature of 400° to 600° C.

24 Claims, 13 Drawing Figures

PROCESS FOR MANUFACTURING METALLURGICAL CABONACEOUS MATERIALS FROM COALS

BACKGROUND OF THE INVENTION

1. Field of the invention:

This invention relates to a process for manufacturing metallurgical carbonaceous materials from coals, and more particularly, a process for manufacturing carbonaceous materials from coals of a low rank of coalification.

2. Description of the prior art:

Heretofore, it has been a common practice to subject low-grade coals to a hydrogenation reaction, so as to convert the same into various kinds of high-grade carbonaceous materials, which may be used as liquid or solid fuel at room temperature, or which may be used for other purposes. There is known, for instance, a process for hydrogenating coals of a low rank of coalification and a high oxygen content, such as subbituminous coal, brown coal, lig-nite and peat, in which coals are subjected to a reduction reaction at high temperature and pressure (300° to 450° C, 50 to 150 atms.) in a mixture gas containing carbon monoxide, steam, and, if desired, hydrogen in the presence of a carbon monoxide base solvent, thereby converting the coals into high-grade carbonaceous materials. (Page 220, No. 3, Volume 12, H. R. Appell & I. Wender: Preprints Symp. Natl. Meeting, Am. Chem. Soc. Div. Fuel Chem.). Carbonaceous materials derived according to the prior art process above described pose no problem when used as fuel. However, these materials are found to be unsuited for use as metallurgical carbonaceous materials for final products, particularly, such as iron making cokes, because of their relatively lower strength. The study by the inventors reveal that the aforesaid shortcomings in carbonaceous materials derived according to the prior art process stem from their high oxygen and hydrogen contents, i.e., a content ratio (in atom) of oxygen-to-carbon of not less than 0.04, and a content ratio (in atom) of hydrogen-to-carbon of not less than 1.0. In this respect, it was also found that for use as metallurgical carbonaceous materials, the content ratio of oxygen-to-carbon should be not more than 0.05, preferably not more than 0.04, and the content ratio of hydrogen-to-carbon should range from 0.5 to 1.0, preferably from 0.6 to 0.8.

SUMMARY OF THE INVENTION

It is an object of the present invention to provide a process for efficiently and economically manufacturing metallurgical carbonaceous materials from coals, i.e., hydrocarbons having a content ratio (in atom) of oxygen-to-carbon of not more than 0.05, and a content ratio of hydrogen-to-carbon in a range from 0.5 to 1.0.

According to the first aspect of the present invention, there is provided a process for manufacturing metallurgical carbonaceous materials from coals. In this process, coals having a carbon content of not more than 75% by weight, and a content ratio (in atom) of oxygen-to-carbon of not less than 0.2, or coal fines of a carbon content of no more than 75% by weight, a content ratio (in atom) of oxygen-to-carbon of not less than 0.2, and an ash content of not more than 4% by weight are mixed with a hydrocarbon base solvent having a boiling point of 150° to 500° C. to form a slurry. The slurry is then subjected to a first treatment, wherein the slurry is heat treated in the presence of mixture gas including carbon monoxide and steam. (In this respect, the amount of carbon monoxide is 0.05 to 2.5 $Nm^3$ to 1 kg, of coal and the amount of steam is 0.15 to 2.0 kg to 1 kg of a coal, or a mixture gas including carbon monoxide, steam and hydrogen (In this respect, a molar ratio of carbon monoxide to hydrogen is 1 to 2.) at a temperature of 300° to 600° C. and a pressure of 50 to 300 atms. The slurry is then subjected to a second heat treatment, wherein a reaction product from the first heat treatment is treated at a temperature of 400° to 600° C., preferably 420° to 470° C., and a pressure of 10 mmHg to 250 atms., in the presence of a hydrogen gas of 0.05 to 2.5 $Nm^3$ per coal of 1 kg.

According to a second aspect of the present invention, there is provided a process of the type described, wherein iron base catalyst containing pure iron and sulfur, or ferro-oxide and sulfur is added to the slurry thus derived.

According to a third aspect of the invention, there is provided a process according to the first and second aspect, wherein the slurry thus derived is preheated at 300° to 450° C. before being subjected to the first heat treatment.

According to a fourth aspect of the invention, there is provided a process according to the third aspect, wherein a reaction product derived from the first heat treatment is subjected to the gas-liquid-separation to remove gas fraction therefrom, and then to a reduced-pressure flash distillation for removing light oil fraction therefrom.

According to a fifth aspect of the invention, there is provided a process according to the first to fourth aspects thereof, wherein a reaction product derived from the second heat treatment is subjected to the gas-liquid separation to remove gas fraction therefrom, and then heavy oil fraction thus obtained is cooled and solidified.

DESCRIPTION OF THE PREFERRED EMBODIMENTS

Figure 1:
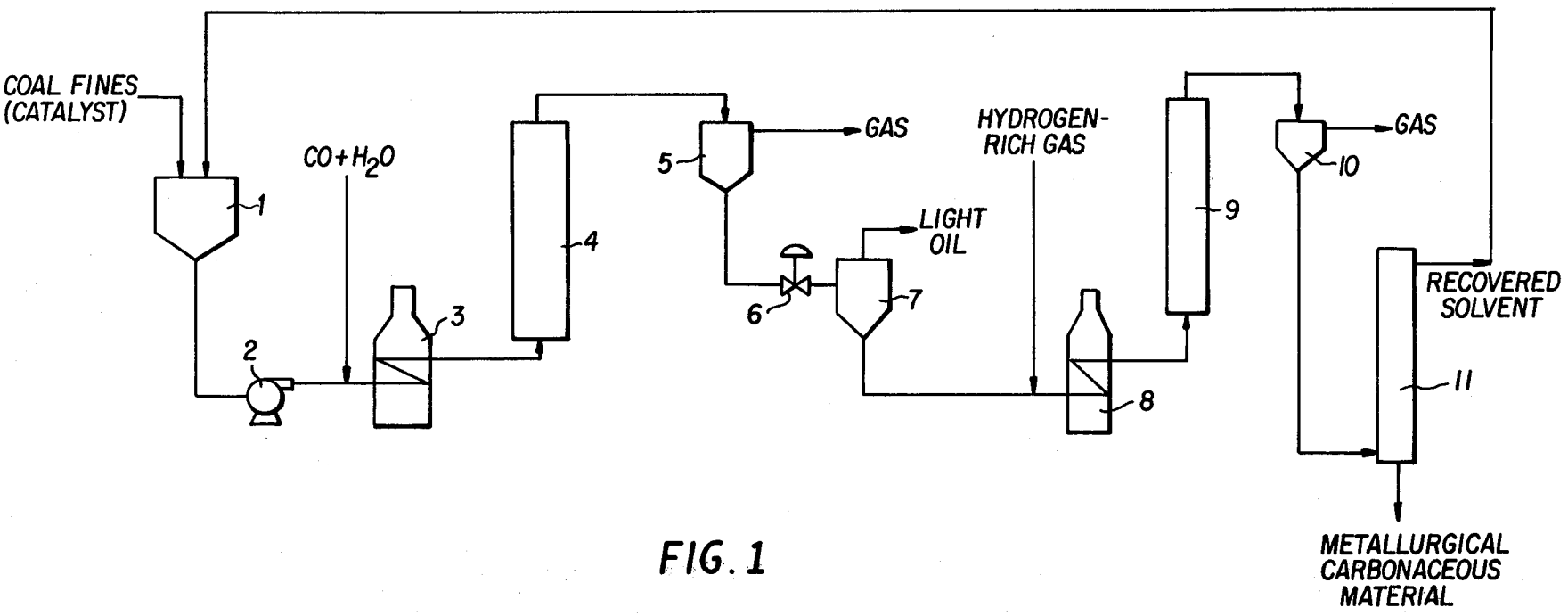
FIG. 1 is a flow sheet illustrative of one embodiment of the process for manufacturing metallurgical carbonaceous materials from coals.
Figure 2A:
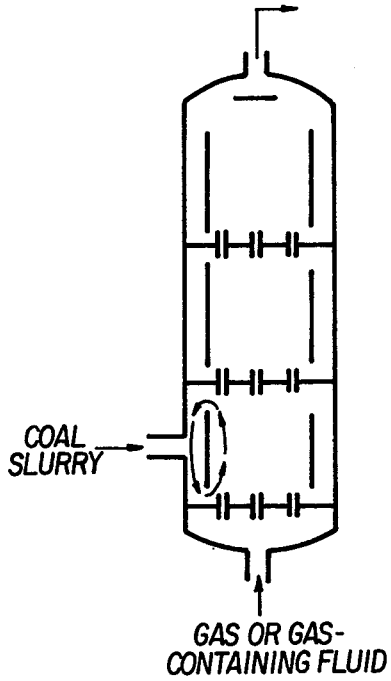
FIG. 2*a* to 2*d*, FIG. 3*a* to 3*d*, and FIG. 4*a* to 4*d* show various modes of a reactor for use for the flow sheet of FIG. 1.
Figure 2B:
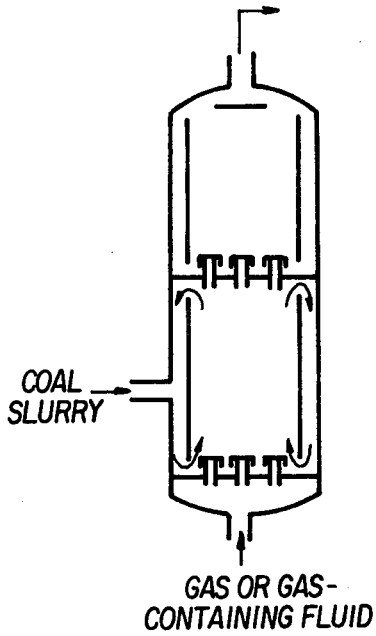
Figure 2C:
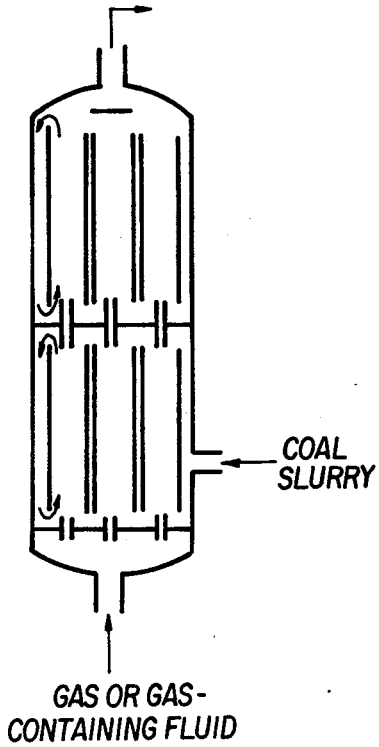
Figure 2D:
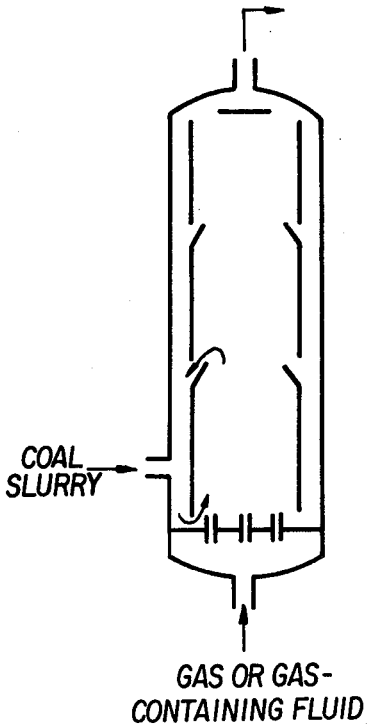
Figure 3A:
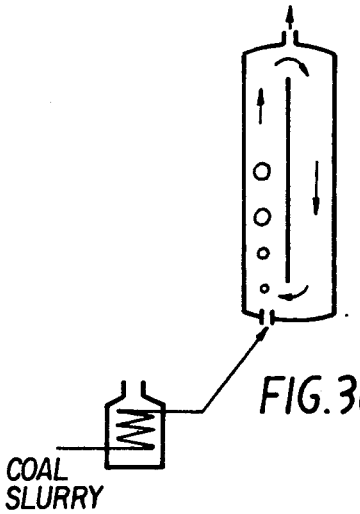
Figure 3B:
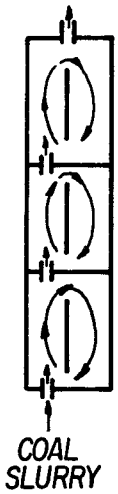
Figure 3C:
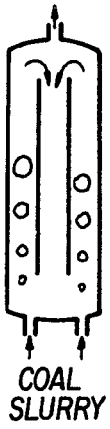
Figure 3D:
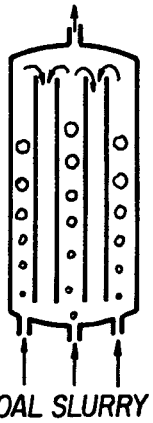
Figure 4A:
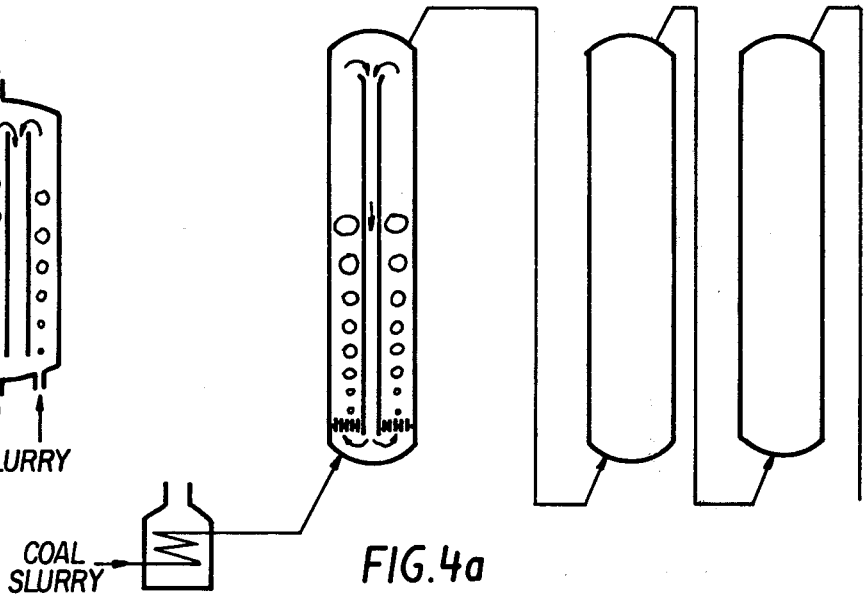
Figure 4C:
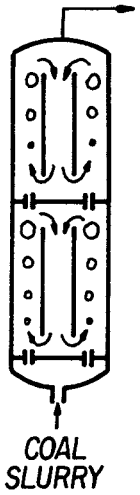
Figure 4D:
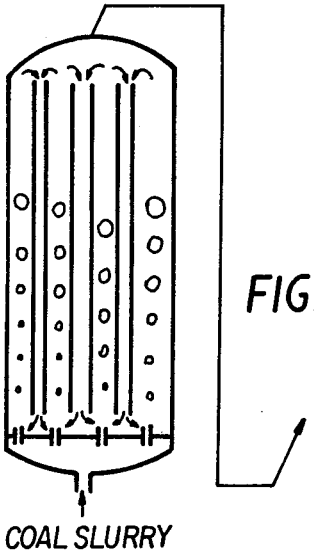
Figure 4B:
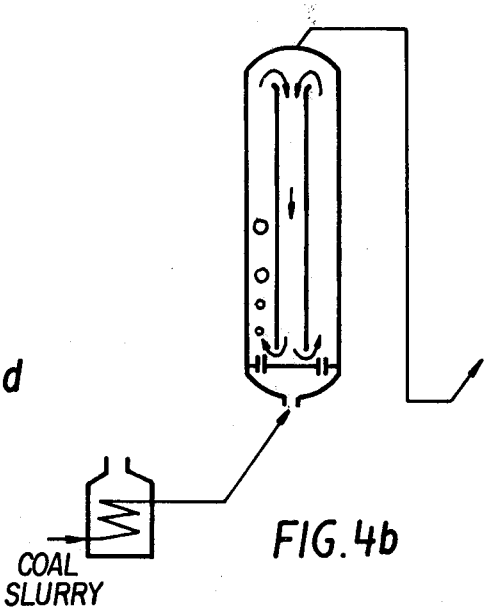

A description will now be given of an outline of a process for manufacturing metallurgical carbonaceous materials from coals of a low rank of coalification, i.e., of a carbon content of not more than 75% [excluding moisture and ash, by weight percent (m.a.f.)] and a content ratio (in atom) of oxygen-to-carbon of not less than 0.2, particularly for manufacturing carbonaceous materials best suited as a raw material for iron-making cokes.

Firstly, coal fines are mixed with a hydrocarbon solvent to form a slurry. The slurry is then preheated in a preheater and subjected to a reduction-decomposition reaction in the presence of a reducing gas in a reactor. (First heat treatment) Then, the product from the liquefaction reaction is subjected to flash distillation, and then phase-separated in a solid-liquid separator, after which a mixture of a heavy oil fraction and a solid fraction is then preheated, while a hydrogen-rich gas of a low practical pressure is blown into the mixture before and after the aforesaid preheating, (preferably before preheating), and then the mixture is subjected to thermal-decomposition-reforming reaction. (Second heat treatment). The reaction product from the thermal-decomposition-reforming reaction is then subjected to distillation to separate a heavy oil fraction therefrom, which is then cooled and solidified, alternatively, a solid fraction may be removed, which is then cooled and solidified.

The order of flash distillation, phase-separation and preheating steps is not critical.

According to the present invention, a mixture gas of carbon monoxide and steam or carbon monoxide, steam and hydrogen may be employed as the aforesaid reducing gas. The liquid product from the first heat treatment carried out in the presence of the above mixture gas is considered to contain less amount of aromatic-condensed-ring-radical-containing compounds, and a large amount of a complex alkyl radical or alicyclic radical compounds. The complex alkyl radical compound may be converted into a hydrocarbon gas of a low molecular weight by being decomposed, or by being converted into aromatic condensed rings by being polycondensed in the thermal-decomposition-reforming reaction at the second step. In the thermal-decomposition-reforming reaction, the presence of a hydrogen gas is not essential. However, for obtaining metallurgical carbonaceous material having a desired content ratio of hydrogen-to-carbon, the reaction should be carried out in the presence of a hydrogen gas for suppressing the excessive reaction. The thermal-decomposition reaction is essentially of a radical reaction in its nature. The hydrocarbon radicals produced due to the decomposition effects mutual polymerization. The reaction thus can be continued unlimitedly as long as the radicals are present, thereby producing coke in which the carbon atoms have been highly ring-polymerized. The coke thus produced will cling to the wall of a reactor firmly, thereby hindering the smooth continuous operation of the reactor and failing to provide products of a desired shape. In contrast thereto, in case hydrogen gas is coexistent the hydrogen itself will be decomposed into a hydrogen radical which in turn will function as a terminator for the radical reaction, thereby preventing excessive progress of the reaction.

In case coals of a low rank of coalification and a less amount of ash, are essentially used as a raw material, it is preferable that a catalyst, which contains iron, be added to the slurry, upon preparation of slurry of coals.

According to the foregoing process of the invention, there may be obtained a product of a desired high-grade, which is employable as a raw material for metallurgical carbonaceous material, for instance, a product of a content ratio (in atom) of oxygen-to-carbon of not more than 0.05%, preferably not more than 0.04% , and a content ratio (in atom) of hydrogen-to-carbon of 0.5 to 1.0, preferably 0.6 to 0.8.

The process according to the present invention will be described in more detail with reference to the accompanying drawings, hereunder.

FIG. 1 is a flow chart illustrative of one embodiment of a process for manufacturing metallurgical carbonaceous material from coals according to the invention.

Firstly, coals of a moisture content of not more than 10% by weight are crushed to less than 100 mesh (preferably 200 mesh), and then a suitable amount of catalyst is added thereto, as required. Then the mixture is mixed with a hydrocarbon base solvent and agitated in a slurry tank 1, thereby preparing a slurry. A hydrocarbon base oil is used as a solvent which is recovered from a distilling column and has a boiling point of 150° to 500° C. The amount of catalyst ranges from about 1 to 4% (by weight) as much as that of entire coals (m.a.f. equivalent).

The slurry thus obtained is then delivered to a preheater 3 by means of a slurry pump 2. At this time, a mixture gas of carbon monoxide (CO) and steam is blown into the preheater 3 as a reducing gas. The mixture gas as used herein consists of carbon monoxide of about 0.05 to 2.5 $Nm^3$ per 1 kg of coal, steam and of 0.15 to 2.0 kg per 1 kg of coal including a moisture contained in the coal.

A mixture of slurry and a reducing gas, which has been preheated at about 300° to 450° C. in the preheater 3, is then introduced into a reactor 4 from its bottom, for a reduction-decomposition reaction at a temperature of about 300° to 600° C. and a pressure of about 50 to 300 atms. The reacted mixture flows out of the top of reactor 4 and is then introduced into a gas-liquid-separator 5, wherein a produced gas and residual reducing gas are separated from each other. A mixture of a liquid fraction and a solid fraction is then subjected to flash-distillation in a pressure reducing valve 6, and then introduced into a solid liquid separator 7. Light oil may be taken out from the top of solid-liquid separator 7, while a mixture of a heavy oil fraction and a solid fraction is taken out from the bottom of the separator 7. Then, a mixture of a heavy liquid fraction and a solid fraction is preheated in the preheater 8 at a temperature of about 400° to 500° C., although a hydrogen rich gas is blown into the preheater in amount of about 0.05 to 2.5 $Nm^3$ per 1 kg of coal, before and after of the preheating (preferably before the preheating). A mixture of a heavy liquid 420° C., C., fraction and a solid fraction plus a hydrogen-rich gas, which have preheated, are then introduced into a reactor 9 which is maintained at a pressure lower than that in the reactor 4 and at a temperature of about 400° to 600° C., preferably 420° to 470° C., and then allowed to stand therein for 10 minutes to 3 hours, followed by the thermal-decomposition-reforming reaction. The reaction mixture, which has been passed out from the top of the reactor 9, is delivered to a gas-liquid separator 10 for gas-liquid separation, or if required, to another gas-liquid separator (not shown) through a pressure reducing valve for reduced-pressure flash distillation to be separated into a gas and a liquid, and then distilled in a distillation column 11. Hydrocarbon base oil, which has been recovered from the distillation column 11 and gas-liquid separator, and has a boiling point of about 150° to 500° C., is circulated into a slurry tank 1 for repeated use of a solvent. The heavy fraction is taken out from the bottom of the distillation column 11, cooled and solidified, or if required, a solid fraction is removed, followed by cooling and solidification, so that the intended metallurgical carbonaceous material may be derived.

When a catalyst is added, the amount of catalyst containing iron should be no less than 10 g, preferably 15 to 30 g, per 1 kg of coal (non-moisture, non-ash content equivalent).

Suitable catalysts which contain iron include pure iron, or ferro-oxides or those to which is added sulfur. In this respect, the content ratio (in atom) of iron-to-sulfur should preferably range from 1:0.5 to 1:2, and the grain size thereof should be less than 100 mesh (preferably 200 mesh).

A reducing gas, which may be employed in the first heat treatment, is a mixture gas of carbon monoxide, steam and hydrogen, other than the aforesaid mixture gas of carbon monoxide and steam.

In this case, carbon monoxide of 0.05 to 2.5 $Nm^3$ per coal of 1 kg, steam of a moisture content of 0.15 to 2.0 kg per coal of 1 kg, including a moisture contained in coal, and hydrogen of a ratio of carbon monoxide to hydrogen, of 1/1 to 2/1 (molar ratio) should preferably be co-existent.

Three phases of gas, liquid and solid are present in the reactor 4, and the respective reacting constituents should be brought into contact, efficiently, in the reactor for achieving the desired chemical reaction.

According to the present invention which is directed to solving the aforesaid problems, and providing compactness and economy of equipment, a reactor of a large diameter is adopted, in which circulating streams are produced therein, without using a circulation motor.

FIGS. 2 to 4 show examples of the reactor.

FIGS. 2*a* to 2*d* show a reactor, in which an inner tube having opposite open ends is placed therein, the coal slurry is introduced into the reactor through a hole provided in the side-surface thereof, and a gas or a fluid, which contains a gas, is introduced into the reactor from a bottom hole therein. A circulating flow of a reaction mixture may be directed from the exterior of the inner tube into the interior thereof and then to the exterior by utilizing the difference in gravity of reaction mixtures inside and outside of the inner tube.

FIGS. 3*a* to 3*d* show reactors, in which a partition wall is positioned within the reactor in the vertical direction, with rooms being left above and below the wall. In this respect, a gas-rich reaction fluid is blown in one side of the partition wall, thereby producing a circulating flow around the partition wall as shown.

FIGS. 4*a* to 4*d* show modifications of reactors shown in FIGS. 2*a* to 2*d*, in which a gas-rich reaction fluid is blown into between an inner tube and an outer tube, thereby producing a ciculating flow as shown.

The foregoing reactors are shown as examples of the reactors.

However, the present invention should not be construed in a limitative sense, and thus any reactors may be employed herein, as far as three phases may be brought into intimate contact with each other, without settling a solid fraction within the reactor.

The following examples are illustrative of the features of the present invention.

EXAMPLE I

Brown coal of Victoria State, Australia (carbon content ... 59.3%, content ratio of oxygen-to-carbon of 0.31, ash ... 0.81%, moisture ... 10%), of 100 parts was mixed with a hydrocarbon base oil mixture of 300 parts, which has a boiling point of about 200° to 415° C., to provide slurry.

A mixture gas of carbon monoxide and steam ($CO:H_2O = 2:1$, molar ratio) was blown into the slurry, and then the mixture gas was heated to about 300° C., and then introduced into a reactor for reaction at a reaction temperature of 390° C. and a pressure of 100 atms. for about 40 minutes. This reaction mixture was subjected to reduced-pressure flash distillation, to be separated into gas and liquid, thereby obtaining a mixture of 216 parts, of a heavy oil fraction and a solid fraction. Then, a hydrogen-rich gas was injected into the lastly referred mixture, followed by preheating at about 430° C., and then the mixture was allowed to stand for about 0.5 hours in the reactor which was maintained at a temperature of about 430° C. and a pressure of 90 atm. Thereafter, the reaction product was subjected to reduced-pressure flash distillation for separation into gas and liquid, and then distilled in a distilling colomn, while a heavy fraction taken out of the bottom of the column was cooled and solidified. As a result, the following metallurgical carbonaceous material of 59 parts was obtained.

a content ratio of oxygen-to-carbon ... 0.041
a content ratio of hydrogen-to-carbon ... 0.775

EXAMPLE II

Brown coal from Victoria State, Australia, of the following composition was subjected to a coal-conversion reaction in the presence and absence of catalysts containing iron:

Composition of coal:
carbon ... 66.5%
hydrogen ...4.9
oxygen ... 27.7 %
nitrogen ... 0.7%
sulfur ... 0.7%
content ratio of oxygen to carbon ... 0.31
ash (moisture free content equivalent) ... 3.6%
volatile matter (moisture free conent equivalent) ... 51.7% fixed carbon ... 47.4%

The reaction condition and coal conversion percentage (based on weight of non-moisture ash)

| | A | B | C | D |
|---|---|---|---|---|
| Reaction temperature (° C) | 390 | 390 | 390 | 390 |
| Reaction pressure (atmospheric pressure) | 100 | 100 | 100 | 100 |
| Reaction time (minute) | 40 | 40 | 40 | 40 |
| Catalyst | Not used | Fe+S | Ferro-oxide+S | Fe+S |
| $CO/H_2O/H_2$* | 2/1/0 | 2/1/0 | 2/1/0 | 2/1/1 |
| Coal/solvent** | 1/3 | 1/3 | 1/3 | 1/3 |
| Coal conversion*** percentage | 80 | 90 | 88 | 91 |

Note: *molar ratio
**ratio by weight
***Coal conversion percentage may be calculated by the following formula:

Coal conversion percentage =

$$\frac{\text{coal supplied (moisture and ash free equivalent)} - \text{(quinoline-insoluble matter)}}{\text{coal supplied (moisture and ash free equivalent)}} \times 100$$

As is apparent from the above table, the process according to the present invention using a catalyst provides a markedly high coal conversion percentage, in terms of the same reaction condition as compared with that of the case devoid of catalyst, and this signifies that the reaction rate in the process according to the process according to the present invention is extremely high.

Meanwhile, a reaction product (D) obtained from the first heat treatment carried out in the above condition was subjected to the reduced-pressure flash distillation as in the preceding example, and then to the gas-liquid separation, thereby obtaining a mixture of a heavy liquid fraction and a solid fraction.

Then, a hydrogen rich gas was blown into the aforesaid mixture, and the mixture was preheated at about 430° C., and allowed to stand for about 0.5 hours in the reactor which has been maintained at a temperature of about 430° C. and a pressure of 90 atmospheric pressure, after which the reaction product was subjected to the reduced-pressure flash distillation for separation into gas and liquid, followed by the distillation in a distilling column. Then, the heavy matter taken out of the bottom of the column was cooled and solidified, thereby obtaining metallurgical carbonaceous material of 59 parts, as follows:

a content ratio of oxygen-to-carbon ... $0.0^{272}$ a content ratio of hydrogen-to-carbon ... $0.6^{86}$ As is apparent from the foregoing, the present invention features that coal slurry is subjected to the first treatment (reduction-decomposition reaction), and then the reaction product derived from the first heat treatment is subjected to the second heat treatment (thermal-decomposition-reforming reaction). As a result, the metallurgical carbonaceous material, such as, for iron making cokes may be obtained from coals of a low grade efficiently economically.

What is claimed is:

1. A process for manufacturing solid metallurgical carbonaceous material having an atomic content ratio of oxygen to carbon of less than 0.05 and an atomic content ratio of hydrogen to carbon ranging from 0.5 to 1 from coals, comprising the steps of:

mixing coal fines with a hydrocarbon solvent having a boiling point of 150° to 500° C. to prepare a slurry; C.

subjecting said slurry to a first reduction-decomposition heat treatment, wherein said slurry is treated at a temperature of 300° to 600° C and a pressure of 50 to 300 atms, in the presence of a mixture gas containing carbon monoxide and steam; and subjecting the reaction product of obtained from said first heat treatment to a second decomposition-reforming heat treatment, wherein said reaction product is treated at a temperature of 420° to 470° C. and a pressure of 10 mmHg to 250 atms in the presence of hydrogen of a low partial pressure.

2. A process as defined in claim 1, wherein said process includes the step of preheating said slurry at 300° to 450° C. before being subjected to said first heat treatment.

3. A process as defined in claim 1, wherein said process further includes the step of subjecting the reaction product obtained from said first heat treatment to gas-liquid separation for removing a gas fraction therefrom, and then to reduced-pressure flash distillation to remove a light oil fraction therefrom.

4. A process as defined in claim 1, wherein said process further includes the step of subjecting the reaction product from said second heat treatment to gas-liquid separation to remove a gas fraction therefrom.

5. A process as defined in claim 4, wherein a heavy fraction obtained from the gas-liquid separation is cooled and solidified.

6. A process as defined in claim 1, wherein said mixture gas includes carbon monoxide of 0.04 to 2.5 $Nm^3$ per 1 kg of coal, and steam of 0.15 to 2.0 kg per kg of coal.

7. A process as defined in claim 1, wherein said mixture gas further includes hydrogen.

8. A process as defined in claim 7, wherein a molar ratio of carbon monoxide to hydrogen ranges from 1 to 2.

9. A process as defined in claim 1, wherein the amount of hydrogen of said low partial pressure ranges from 0.05 to 2.5 $Nm^3$ per 1 kg of coal.

10. A process as defined in claim 1, wherein the weight ratio, of said solvent to said coals ranges from 1 to 4.

11. A process as defined in claim 1, wherein an iron base catalyst is added to said slurry.

12. A process as defined in claim 11, wherein said iron base catalyst consists of pure iron and sulfur.

13. A process as defined in claim 11, wherein said iron base catalyst consists of ferro-oxide and sulfur.

14. A process as defined in claim 12, wherein the atomic ratio, of iron to sulfur ranges from 0.5 to 2.

15. A process as defined in claim 11, wherein said catalyst is added, in amount of no less than 10g, to slurry, per 1 kg of coal.

16. A process as defined in claim 5, wherein said catalyst is added in amount of 15 to 30g to said slurry per 1 kg of coal.

17. A process as defined in claim 1, wherein said coals include carbon of not more than 75% by weight, and have a content ratio (in atom) of oxygen-to-carbon of not less than 0.2.

18. A process as defined in claim 1, wherein said coals include carbon of not more than 75% by weight, an ash of not more than 4% by weight, and have a content ratio (in atom) of oxygen-to-carbon of not less than 0.2.

19. A process as defined in claim 1, wherein said coals are brown coals.

20. A process as defined in claim 1, wherein the atomic content ratio of oxygen-to-carbon should be less than 0.04, and the atomic content ratio of hydrogen to carbon ranges from 0.6 to 0.8.

21. The metallurgical carbonaceous material produced by the process of claim 1.

22. The metallurgical carbonaceous material produced by the process of claim 3.

23. The metallurgical carbonaceous material produced by the process of claim 4.

24. The metallurgical carbonaceous material produced by the process of claim 20.

* * * * *

UNITED STATES PATENT AND TRADEMARK OFFICE

CERTIFICATE OF CORRECTION

PATENT NO. : 4,144,033
DATED : March 13, 1979
INVENTOR(S) : Nakako et al.

It is certified that error appears in the above-identified patent and that said Letters Patent are hereby corrected as shown below:

In the title, change "CABONACEOUS" to --CARBONACEOUS--.

Column 1, in the title, change "CABONACEOUS" to --CARBONACEOUS--; still Column 1, line 22, delete "lig-nite" and insert --lignite--.

Column 2, line 3, delete "1 kg," and insert --1 kg--; still Column 2, line 36, change "then" to --the--.

Column 4, line 36, delete "420°C., C.,".

Column 6, line 26, change "colomn" to --column--.

Column 7, line 26, change "$0.0^{272}$" to --0.0272--; still Column 7, line 27, change "$0.6^{86}$" to --0.686--; still Column 7, line 45, delete "C.".

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*